US011415095B2

(12) United States Patent
Kondou et al.

(10) Patent No.: US 11,415,095 B2
(45) Date of Patent: Aug. 16, 2022

(54) FUEL INJECTION VALVE

(71) Applicant: DENSO CORPORATION, Kariya (JP)

(72) Inventors: Atsushi Kondou, Kariya (JP); Tomonori Kamiya, Kariya (JP); Yoshinori Okuno, Kariya (JP)

(73) Assignee: DENSO CORPORATION, Kariya (JP)

( * ) Notice: Subject to any disclaimer, the term of this patent is extended or adjusted under 35 U.S.C. 154(b) by 43 days.

(21) Appl. No.: 16/984,540

(22) Filed: Aug. 4, 2020

(65) Prior Publication Data

US 2021/0040928 A1 Feb. 11, 2021

(30) Foreign Application Priority Data

Aug. 6, 2019 (JP) ..... JP2019-144560

(51) Int. Cl.
*F02M 55/00* (2006.01)
*F02M 61/04* (2006.01)

(52) U.S. Cl.
CPC ..... *F02M 61/042* (2013.01); *F02M 55/008* (2013.01); *F02M 2200/247* (2013.01)

(58) Field of Classification Search
CPC ..... F02M 61/042; F02M 55/008; F02M 2200/247
USPC ..... 239/533.2
See application file for complete search history.

(56) References Cited

U.S. PATENT DOCUMENTS 6,425,879 B1 * 7/2002 Egger ..... A61M 5/30 604/67
6,497,223 B1 * 12/2002 Tuken ..... F02D 33/006 123/456
6,598,591 B2 * 7/2003 Lewis ..... F02M 47/027 123/467
7,343,809 B2 * 3/2008 Baumann ..... F02D 41/3827 73/728
7,552,717 B2 * 6/2009 Dingle ..... F02D 41/40 123/480
2011/0000465 A1 1/2011 Stoecklein et al.

FOREIGN PATENT DOCUMENTS

JP 2017-25806 2/2017
JP 2017-72113 4/2017
JP 2017-101632 6/2017

* cited by examiner

*Primary Examiner* — Chee-Chong Lee
(74) *Attorney, Agent, or Firm* — Nixon & Vanderhye P.C.

(57) ABSTRACT

A fuel injection valve includes a nozzle portion for injecting fuel, a fuel inlet port, a fuel supply main passage for supplying the fuel from the fuel inlet port to the nozzle portion, a pressure sensor for detecting fuel pressure in the fuel supply main passage, and a fuel introduce passage for supplying the fuel from the fuel supply main passage to the pressure sensor. The fuel supply main passage includes a first fuel supply passage extending in a first direction from the fuel inlet port to the pressure sensor and a second fuel supply passage extending in a second direction from the pressure sensor to the nozzle portion.

6 Claims, 7 Drawing Sheets

FUEL INJECTION VALVE

CROSS REFERENCE TO RELATED APPLICATION

This application is based on Japanese Patent Application No. 2019-144560 filed on Aug. 6, 2019, the disclosure of which is incorporated herein by reference.

FIELD OF TECHNOLOGY

The present disclosure relates to a fuel injection valve, according to which fuel pressure is detected by a built-in sensor.

BACKGROUND

It is known in the art to detect a change of fuel pressure, which is generated when injecting fuel from a fuel injection valve, by a pressure sensor built in the fuel injection valve.

For example, in one of prior arts, a divergent passage is formed in a fuel injection valve for supplying fuel to a pressure sensor provided in the fuel injection valve, wherein the divergent passage diverges from a main passage extending from a fuel inlet port to an injection hole of a nozzle portion for injecting the fuel therefrom. An injection wave is generated in accordance with a valve opening and a valve closing operations of the fuel injection valve and transmitted from the main passage to the divergent passage. The injection wave transmitted to the divergent passage is reflected at a boundary between the main passage and the divergent passage. The injection wave transmitted to the divergent passage is referred to as a reflecting wave, which moves in the divergent passage in a reciprocal manner. A passage length of the divergent passage is set at such a value that a frequency range of the reflecting wave is apart from a frequency range of the injection wave.

In the above prior art, the passage length of the divergent passage is made to be shorter than a passage length of the main passage in order that the frequency range of a frequency component of the reflecting wave deviates from the frequency range of a frequency component of the injection wave in a direction to a higher frequency side and thereby an interference between the injection wave and the reflecting wave is avoided.

In the above prior art, the fuel is supplied to the pressure sensor through the divergent passage, which diverges from the main passage extending from the fuel inlet port to the nozzle portion. There is a case, in which the passage length of the divergent passage cannot be set at a desired value depending on a positional relationship between the fuel inlet port and the pressure sensor.

For example, in a case that the fuel inlet port is formed in the fuel injection valve at such a position, which is separated from a longitudinal center of the fuel injection valve on a side closer to the nozzle portion, and that the pressure sensor is provided at an axial end of the fuel injection valve opposite to the nozzle portion, it is not always possible to make the passage length of the divergent passage to be shorter than the passage length of the main passage.

SUMMARY OF THE DISCLOSURE

It is an object of the present disclosure to provide a fuel injection valve, according to which fuel pressure can be detected by a pressure sensor with a high degree of accuracy, independently of positions of a fuel inlet port and the pressure sensor.

BRIEF DESCRIPTION OF THE DRAWINGS

The above and other objects, features and advantages of the present disclosure will become more apparent from the following detailed description made with reference to the accompanying drawings. In the drawings.

DETAILED DESCRIPTION OF THE EMBODIMENTS

Figure 1:
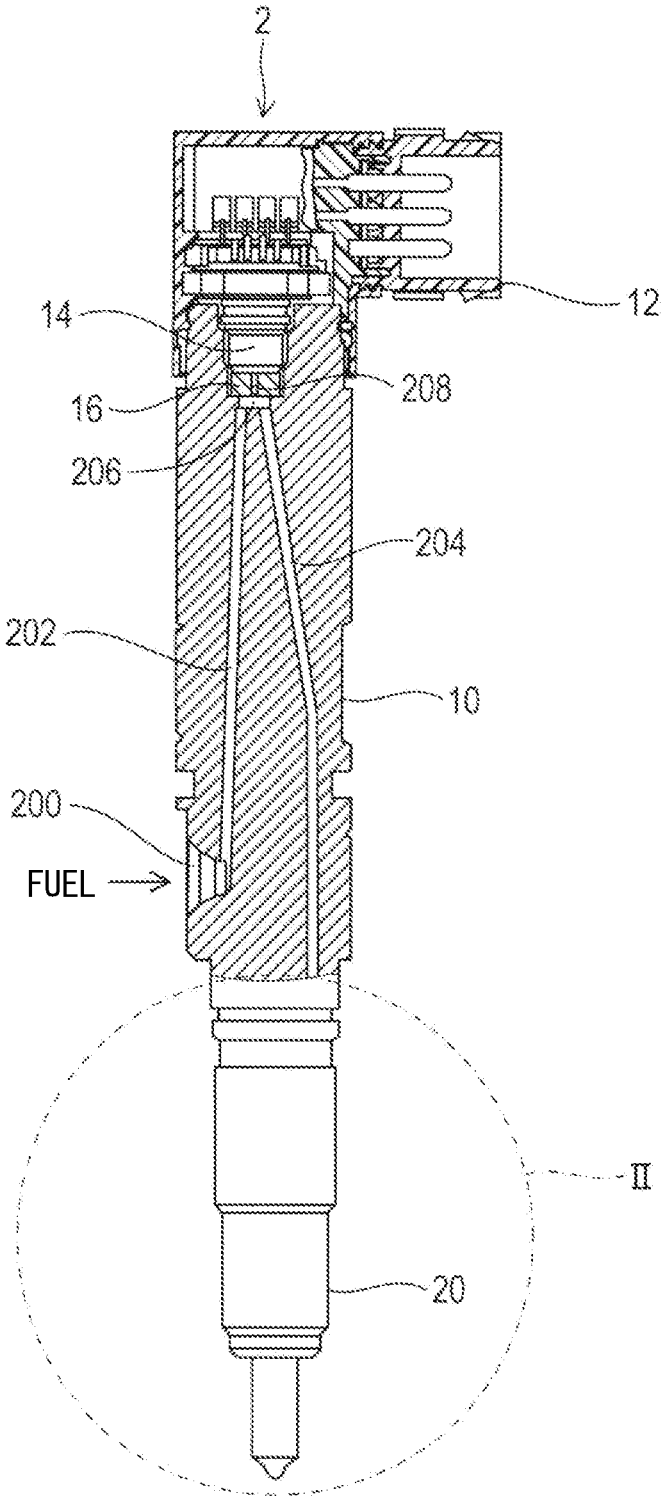
FIG. 1 is a schematic and partial cross-sectional view showing a fuel injection valve according to a first embodiment of the present disclosure.

The present disclosure will be explained hereinafter by way of multiple embodiments and/or modifications with reference to the drawings. The same reference numerals are given to the same or similar structures and/or portions in order to avoid repeated explanation.

First Embodiment

Structure

A fuel injection valve 2 of a first embodiment of the present disclosure is shown in FIG. 1.

A nozzle portion 20 for injecting fuel is provided at an axial end of a valve body 10. A connector 12 is provided at an opposite-side axial end of the nozzle portion 20 of the fuel injection valve 2. The connector 12 includes a terminal for supplying electric power to a coil working as an electromagnetic driving portion and a terminal for outputting a detection signal of a pressure sensor 14.

The fuel injection valve 2 is installed in, for example, a diesel engine for injecting high-pressure fuel stored in a common rail from the nozzle portion 20. The high-pressure fuel stored in the common rail is supplied from a fuel inlet port 200 to the nozzle portion 20 of the fuel injection valve 2 via a first fuel supply passage 202 and a second fuel supply passage 204. The first fuel supply passage 202 and the second fuel supply passage 204 are collectively referred to as a fuel supply main passage 202-204. The fuel inlet port 200 is connected to a fuel pipe (not shown) by a coupling device of a connector type or a screw type.

The fuel inlet port 200 is formed at a position separated from a longitudinal center of the fuel injection valve 2 on a side closer to the nozzle portion 20. The first fuel supply passage 202 is connected to the fuel inlet port 200 and extends in a first direction to the pressure sensor 14, which is an opposite direction to the nozzle portion 20. The second fuel supply passage 204 is connected to the nozzle portion 20 and extends in a second direction from a side of the pressure sensor 14 to the nozzle portion 20. The first fuel supply passage 202 and the second fuel supply passage 204 are connected to each other via a passage connecting portion 206.

As above, the fuel supply main passage 202-204 including the first and the second fuel supply passages 202 and 204 extends in the first direction from the fuel inlet port 200 to the pressure sensor 14 and then extends in the second direction from the pressure sensor 14 to the nozzle portion 20.

A shim 16 is interposed between the valve body 10 and the pressure sensor 14. A fuel introduce passage 208 is formed in the shim 16 in such a way that the fuel introduce passage 208 passes through the shim 16. The fuel introduce passage 28 is connected to the passage connecting portion 206 and introduces the fuel of the passage connecting portion 206 to the pressure sensor 14. The passage connecting portion 206 is formed in a space between the shim 16 and the valve body 10. The pressure sensor 14 is built in the fuel injection valve 2 and detects fuel pressure in the second fuel supply passage 204 via the passage connecting portion 206 and the fuel introduce passage 208.

When a passage area of the second fuel supply passage 204 is defined as "S1", a passage area of the first fuel supply passage 202 is defined as "S2" and a passage area of the passage connecting portion 206 is defined as "S3", a relationship of "$S1 \leq S2 \leq S3$" is satisfied in the present embodiment. Since the passage area "S3" of the passage connecting portion 206 is equal to or larger than each of the passage area "S1" of the second fuel supply passage 204 and the passage area "S2" of the first fuel supply passage 202, it is avoided that the passage connecting portion 206 for communicating the first fuel supply passage 202 to the second fuel supply passage 204 would become a restriction in the fuel supply main passage 202-204.

Since the passage area "S2" of the first fuel supply passage 202 is equal to or larger than the passage area "S1" of the second fuel supply passage 204, it is avoided that an amount of the fuel to be supplied from the first fuel supply passage 202 to the second fuel supply passage 204 becomes insufficient.

Figure 2:
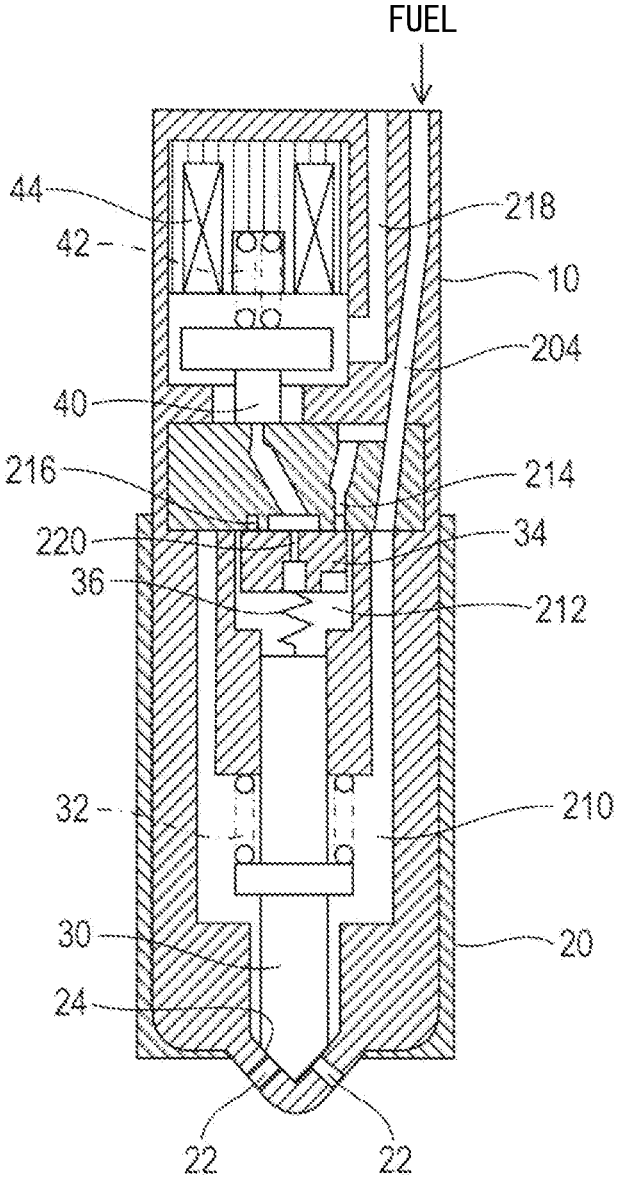
FIG. 2 is a schematically enlarged cross-sectional view showing a portion II (a nozzle portion) in FIG. 1.

As shown in FIG. 2, the fuel of the second fuel supply passage 204 is supplied to a fuel chamber 210, which is formed at an upstream side of injection holes 22. Fuel pressure in the fuel chamber 210 generates a force applied to a nozzle needle 30 in an upward direction separated from a valve seat 24. A spring 32 applies a spring load to the nozzle needle 30 in a downward direction to the valve seat 24.

A pressure control chamber 212 is formed on an axial side of the nozzle needle 30, which is opposite to the injection holes 22. A part of the fuel in the second fuel supply passage 204 is supplied to an annular fuel passage 216 via an orifice 214. As shown in FIG. 2, in an off-condition of power supply to a coil 44, the pressure control chamber 212 is filled with high pressure fuel. The nozzle needle 30 receives the spring load of the spring 32 and a force of the fuel pressure in the pressure control chamber 212 in the downward direction to the valve seat 24.

A control plate 34 receives a force in the upward direction closing a fluid path between the annular fuel passage 216 and the pressure control chamber 212, which is generated by a spring load of a spring 36 accommodated in the pressure control chamber 212 and the fuel pressure in the pressure control chamber 212. The control plate 34 also receives a force in the downward direction to the nozzle needle 30, namely in a direction for opening the fluid path between the annular fuel passage 216 and the pressure control chamber 212, which is generated by the fuel pressure in the annular fuel passage 216.

As shown in FIG. 2, when the pressure control chamber 212 is filled with the high pressure fuel, since the force received by the control plate 34 from the spring load of the spring 36 and the fuel pressure in the pressure control chamber 212 is larger than the force received by the control plate 34 from the fuel pressure in the annular fuel passage 216, the control plate 34 closes the fluid path between the annular fuel passage 216 and the pressure control chamber 212.

A communication condition or a non-communication condition (a shut-down condition of the fluid path) between the pressure control chamber 212 and a low-pressure side fuel passage 218 is controlled by a valve member 40. The valve member 40 receives a spring load from a spring 42 in the downward direction for shutting down the fluid path between the pressure control chamber 212 and the low-pressure side fuel passage 218. In addition, the valve member 40 receives a force from the fuel pressure in the pressure control chamber 212 in the upward direction for opening the fluid path between the pressure control chamber 212 and the low-pressure side fuel passage 218.

When the power supply to the coil 44 is turned on, the valve member 40 receives an electromagnetic force in the upward direction for opening the fluid path between the pressure control chamber 212 and the low-pressure side fuel passage 218. The force received by the valve member 40 from the fuel pressure in the pressure control chamber 212 and the electromagnetic force of the coil 44, which is the force in the upward direction for opening the fluid path between the pressure control chamber 212 and the low-pressure side fuel passage 218, is larger than the spring load of the spring 42. Therefore, when the power supply to the coil 44 is turned on, the valve member 40 is moved in the upward direction for opening the fluid path between the pressure control chamber 212 and the low-pressure side fuel passage 218.

When the power supply to the coil 44 is turned on and the fluid path between the pressure control chamber 212 and the low-pressure side fuel passage 218 is thereby opened, the fuel in the pressure control chamber 212 is discharged to the low-pressure side fuel passage 218 via an orifice 220. The pressure in the pressure control chamber 212 is thereby decreased.

When the pressure in the pressure control chamber 212 is decreased, the force received by the nozzle needle 30 from the fuel pressure in the fuel chamber 210 in the upward direction separating from the valve seat 24 becomes larger than the force received by the nozzle needle 30 from the spring load of the spring 32 and the fuel pressure in the pressure control chamber 212 in the downward direction to the valve seat 24. As a result, when the power supply to the coil 44 is turned on, the nozzle needle 30 is separated from the valve seat 24 and thereby the fuel is injected from the injection holes 22.

In addition, the fuel pressure in the pressure control chamber 212 is decreased, the control plate 34 is moved in the downward direction to the nozzle needle 30 by the force received by the control plate 34 from the fuel pressure in the annular fuel passage 216 against the force received by the control plate 34 from the spring load of the spring 36 and the fuel pressure in the pressure control chamber 212. Then, since the fluid path between the annular fuel passage 216 and the pressure control chamber 212 is opened, the high pressure fuel flows from the annular fuel passage 216 into the pressure control chamber 212.

During a period in which the power supply to the coil 44 is turned on, since the fuel in the pressure control chamber 212 is continuously discharged to the low-pressure side fuel passage 218 and thereby the fuel pressure in the pressure control chamber 212 is decreased, the fluid path opened condition between the annular fuel passage 216 and the pressure control chamber 212 is maintained.

When the power supply to the coil 44 is turned off, the fluid path between the pressure control chamber 212 and the low-pressure side fuel passage 218 is closed. The fuel pressure in the pressure control chamber 212 is thereby increased by the fuel supplied from the annular fuel passage 216. Then, the force received by the control plate 34 from the spring load of the spring 36 and the fuel pressure in the pressure control chamber 212 becomes larger than the force received by the control plate 34 from the fuel pressure in the annular fuel passage 216. The control plate 34 thereby shuts off the fluid path between the annular fuel passage 216 and the pressure control chamber 212.

Figure 3:
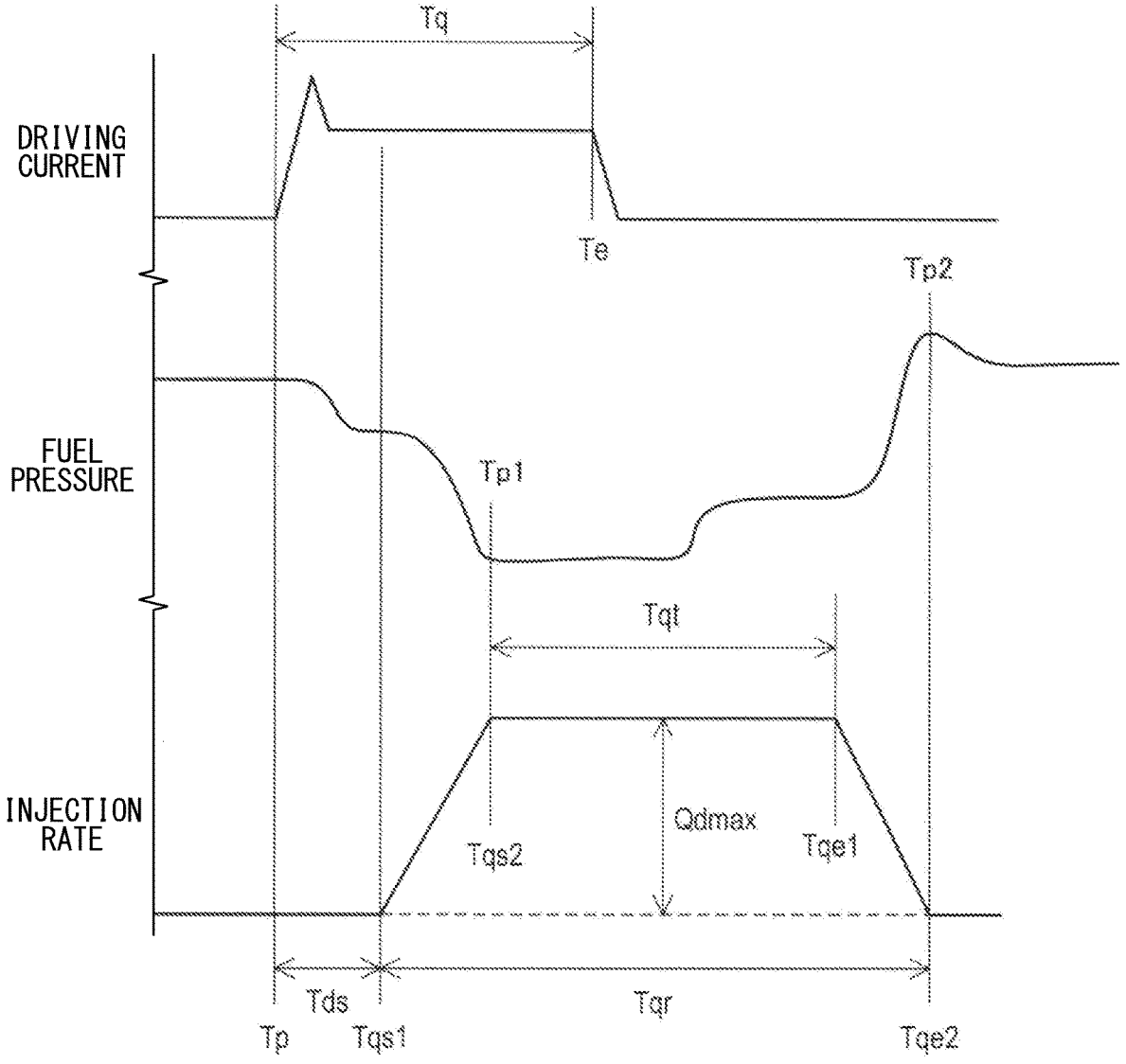
FIG. 3 is a time chart showing a relationship among a driving current, a fuel pressure and a fuel injection rate.

The fuel pressure detected by the pressure sensor 14 will be explained. As shown in FIG. 3, when the power supply to the coil 44 is turned on at a timing "Tp" (a supply start timing "Tp"; explained below) and driving current is supplied to the coil 44, the valve member 40 is moved in the upward direction for opening the fluid path between the pressure control chamber 212 and the annular fuel passage 216, so that the fuel pressure in the pressure control chamber 212 is decreased. Then, the nozzle needle 30 is separated from the valve seat 24 after a predetermined delay time "Tds" passes over and the fuel injection from the injection holes 22 starts at a timing "Tqs1" (a rate-increase start timing "Tqs1"; explained below).

When the fuel pressure is decreased in the pressure control chamber 212, the fuel pressure is correspondingly decreased in the second fuel supply passage 204. When the fuel pressure is decreased in the second fuel supply passage 204, the fuel pressure in the passage connecting portion 206 and the fuel introduce passage 208 are correspondingly decreased. Therefore, as shown in FIG. 3, the fuel pressure detected by the pressure sensor 14 is decreased.

When the power supply to the coil 44 is turned off at a timing "Te" and the supply of the driving current to the coil 44 is shut down, the valve member 40 is moved in the downward direction to shut down the fluid path between the pressure control chamber 212 and the annular fuel passage 216. The fuel pressure in the pressure control chamber 212 is thereby increased. As a result, since the nozzle needle 30 is seated on the valve seat 24, the fuel injection from the injection holes 22 is cut off at a timing "Tqe2" (a rate-decrease end timing "Tqe2"; explained below).

When the fuel pressure is increased in the pressure control chamber 212, the fuel pressure is correspondingly increased in the second fuel supply passage 204. When the fuel pressure is increased in the second fuel supply passage 204, the fuel pressure in the passage connecting portion 206 as well as the fuel pressure in the fuel introduce passage 208 is correspondingly increased. As a result, the fuel pressure detected by the pressure sensor 14 is increased, as shown in FIG. 3.

As shown in FIG. 3, the injection rate is changed in response to the change of the fuel pressure detected by the pressure sensor 14. In other words, it is possible to estimate the injection rate based on the fuel pressure detected by the pressure sensor 14. An electronic control unit (hereinafter, ECU: not shown) estimates the injection rate of the fuel injection valve 2 with respect to the driving current, based on the fuel pressure detected by the pressure sensor 14.

It is possible to estimate the rate-increase start timing "Tqs1" and a rate-increase end timing "Tqs2" of the injection rate, based on a pressure change timing "Tp1" and a pressure decrease rate of the fuel pressure prior to the pressure change timing "Tp1". In addition, it is possible to estimate a rate-decrease start timing "Tqe1" and the rate-decrease end timing "Tqe2" of the injection rate, based on a pressure change timing "Tp2" and a pressure increase rate of the fuel pressure prior to the pressure change timing "Tp2".

Furthermore, it is possible to estimate a maximum injection rate "Qdmax" of the injection rate, for example, based on a maximum decrease amount of the fuel pressure. The ECU approximates a waveform of the injection rate by a trapezium, based on the above estimated values. A fuel injection amount "Q" can be obtained by a following formula 1, which indicates an area of the approximated trapezium. In the formula 1, "Tqr=Tqe2−Tqs1" and "Tqt=Tqe1−Tqs2".

$$Q=(Tqr+Tqt)\times Qd\max/2 \quad \text{(formula 1)}$$

The ECU determines whether an estimated injection rate is deviated from a target injection rate or not. When the ECU determines that the estimated injection rate is deviated from the target injection rate, the ECU adjusts the supply start timing "Tp" of the driving current and a power supply period "Tq" in such a way that the estimated injection rate becomes closer to the target injection rate.

When the fuel injection valve 2 is opened and closed for injecting the fuel, an injection wave (equal to a pressure pulsation) of the fuel is generated in the second fuel supply passage 204. The injection wave is transmitted from the second fuel supply passage 204 to the fuel introduce passage 208 via the passage connecting portion 206. The injection wave transmitted to the fuel introduce passage 208 represents a change of the fuel pressure in the second fuel supply passage 204.

Since the injection wave transmitted to the fuel introduce passage 208 is reflected from a boundary between the passage connecting portion 206 and the fuel introduce passage 208, a reflecting wave is generated in the fuel introduce passage 208. In a case that a frequency range of the injection wave overlaps a frequency range of the reflecting wave, the injection wave and the reflecting wave interfere with each other in the fuel introduce passage 208. As shown in an upper-side graph of FIG. 4, the fuel pressure in the fuel introduce passage 208 detected by the pressure sensor 14 becomes a wave form, which is obtained by the interference between the injection wave and the reflecting wave. Therefore, it is difficult to estimate the change of the fuel pressure in the second fuel supply passage 204 based on the wave form, in which the injection wave and the reflecting wave interfere with each other.

Figure 4:
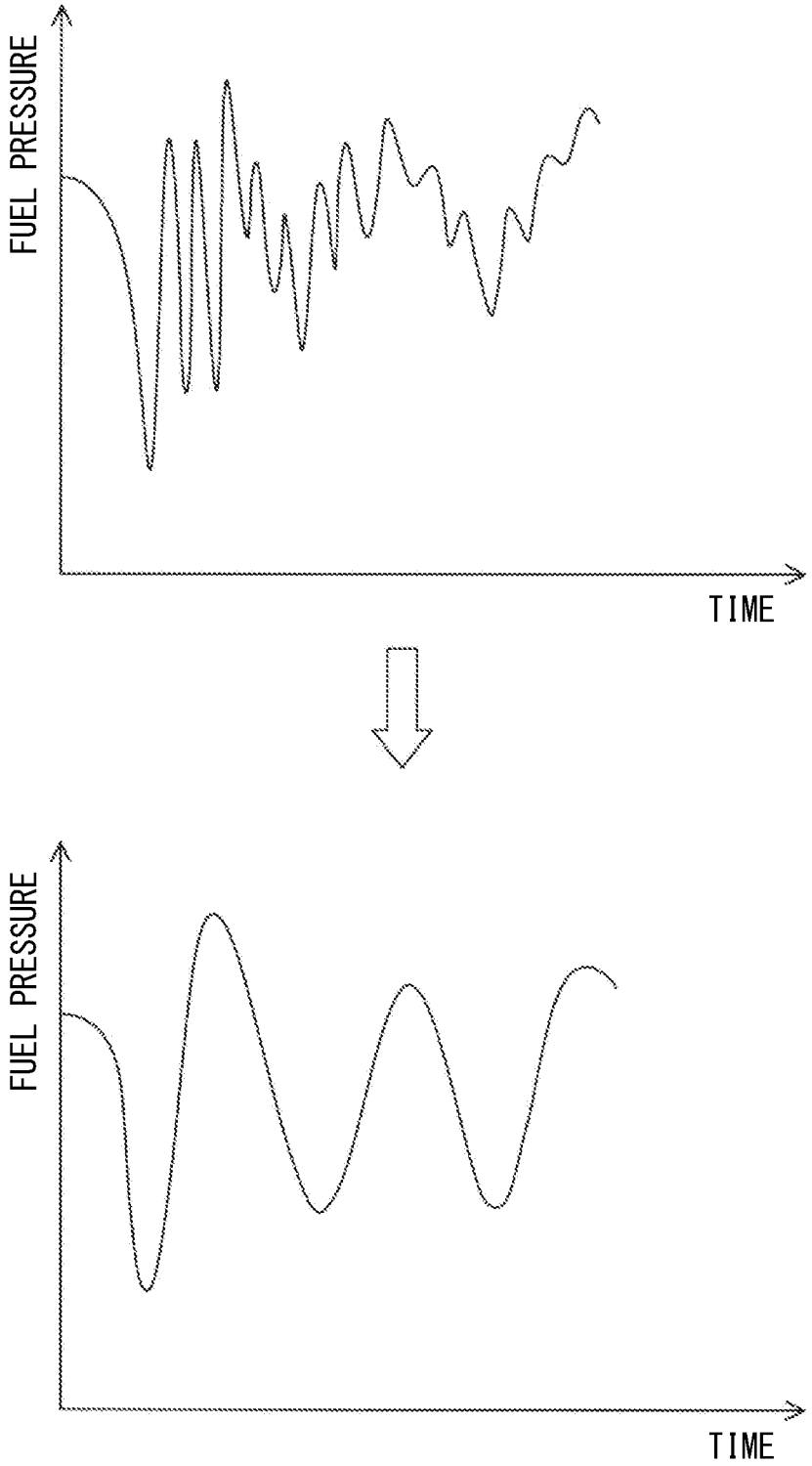
FIG. 4 is a graph showing an interference suppressing effect of the fuel pressure.

The upper-side graph of FIG. 4 shows the wave form of the fuel pressure only for explaining the interference between the injection wave and the reflecting wave. The upper-side graph of FIG. 4 does not show the actual change of the fuel pressure generated by the fuel injection of the fuel injection valve 2. In the case that the frequency range of the injection wave overlaps the frequency range of the reflecting wave, it is difficult to remove by a filter a frequency component of the reflecting wave from the wave form, in which the injection wave and the reflecting wave interfere with each other.

In the present embodiment, a passage length of the second fuel supply passage 204 is defined as "L1" and a passage length of the fuel introduce passage 208 is defined as "L2". The passage lengths of "L1" and "L2" are made to satisfy a relationship of "L1>L2". More preferably, the passage lengths are made to satisfy a relationship of "L1>2×L2". A passage length of the first fuel supply passage 202 is shorter than that of the second fuel supply passage 204.

The passage length "L1" of the second fuel supply passage 204 corresponds to a distance between a first connecting portion at which the second fuel supply passage 204 is connected to the passage connecting portion 206 and the nozzle portion 20. In other words, the passage length "L1" of the second fuel supply passage 204 corresponds to the distance between the first connecting portion at which the second fuel supply passage 204 is connected to the passage connecting portion 206 and a second connecting portion at which the second fuel supply passage 204 is connected to the fuel chamber 210.

Since the passage length "L2" of the fuel supply passage 208 is shorter than the passage length "L1" of the second fuel supply passage 204, the frequency of the reflecting wave becomes higher than the frequency of the injection wave. Therefore, as shown in a lower-side graph of FIG. 4, it is possible to obtain the frequency component of the injection wave by removing the frequency component of the reflecting wave, based on the detection signal of the pressure signal 14. As a result, it is possible to accurately detect the change of the fuel pressure, which is generated in the second fuel supply passage 204 by the fuel injection of the fuel injection valve 2.

In addition, in the present embodiment, a passage area of the fuel introduce passage 208 is defined as "S4". The passage areas "S1" and "S4" are so made to satisfy a relationship of "S1≥S4". Since the passage area "S1" of the second fuel supply passage 204 is equal to or larger than the passage area "S4" of the fuel introduce passage 208, the fuel introduce passage 208 works as a damper and thereby it is possible to suppress that the injection wave attenuates in the second fuel supply passage 204.

Advantages

The above explained first embodiment has the following advantages:

(A1) In a comparative example, in which the fuel inlet port (200) is provided at the position separated from the longitudinal center of the fuel injection valve (2) in the direction to the nozzle portion (20). The pressure sensor (14) is provided at the axial end of the fuel injection valve (2) on the opposite to the nozzle portion (20). The fuel introduce passage (208) branches off from the fuel supply main passage (202 and 204) straightly extending from the fuel inlet port (200) to the nozzle portion (20). The fuel introduce passage (208) supplies the fuel from the fuel supply main passage to the pressure sensor (14). In the above structure of the fuel injection valve (2) of the comparative example, it is difficult to make the passage length of the fuel introduce passage to be smaller than a predetermined value.

In the above first embodiment, however, the fuel supply main passage 202-204 is composed of the first fuel supply passage 202 extending in the first direction from the fuel inlet port 200 to the pressure sensor 14 and the second fuel supply passage 204 extending in the second direction from the pressure sensor 14 to the nozzle portion 20. The first direction and the second direction are opposite to each other in an axial direction of the fuel injection valve 2. The fuel is supplied to the pressure sensor 14 through the fuel introduce passage 208 from the passage connecting portion 206, which connects the first and the second fuel supply passages 202 and 204 to each other.

In the above structure of the present embodiment, it is possible to design the fuel supply main passage 202-204 in such a way that the fuel supply main passage 202-204 extends in the first direction to the pressure sensor 14 and then the fuel supply main passage 202-204 extends in the second direction from the portion adjacent to the pressure sensor 14 to the nozzle portion 20. Therefore, it is possible to design a path of the fuel supply main passage 202-204 in such a way that the length of the fuel introduce passage 208 through which the fuel is supplied from the fuel supply main passage 202-204 to the pressure sensor 14 can be made shorter.

As a result of the above structure, it is possible to decide the length of the fuel introduce passage 208 in such a way that the injection wave and the reflecting wave do not interfere with each other. Namely, the injection wave is transmitted from the fuel supply main passage 202-204 to the fuel introduce passage 208, while the injection wave is reflected at the boundary between the fuel supply main passage 202-204 and the fuel introduce passage 208 and thereby the reflecting wave reciprocating in the fuel introduce passage 208 is generated. In the present embodiment, the frequency range of the reflecting wave is separated from the frequency range of the injection wave, to avoid thereby the interference between them.

It is, therefore, possible to precisely detect the fuel pressure by the pressure sensor 14, independently from the positions of the fuel inlet port 200 and the pressure sensor 14.

(A2) In the present embodiment, the fuel introduce passage 208 is formed in the shim 16 and the passage connecting portion 206 is formed in the space between the shim 16 and the valve body 10. Therefore, it is possible to easily manufacture and form the passage connecting portion 206.

In the above first embodiment, the shim 16 works as an interposed member.

Second & Third Embodiments

A basic structure of each of a second embodiment and a third embodiment is the same to that of the first embodiment. Different points between them will be explained.

Figure 5:
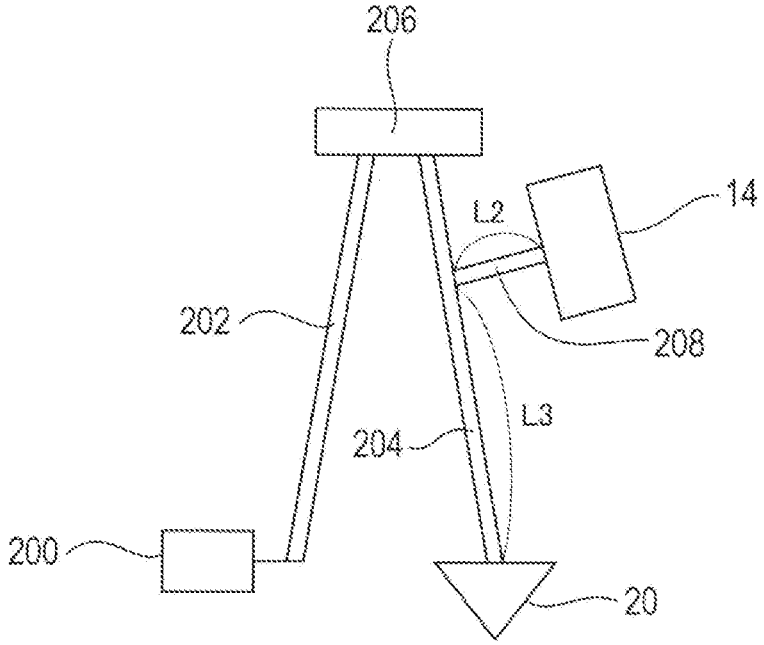
FIG. 5 is a schematic view showing an installation position of a pressure sensor according to a second embodiment of the present disclosure.

In the above first embodiment, the fuel introduce passage 208 for the pressure sensor 14 is connected to the passage connecting portion 206. According to the second embodiment shown in FIG. 5, it is different from the first embodiment in that the fuel introduce passage 208 is connected not to the passage connecting portion 206 but to a middle point of the second fuel supply passage 204. The fuel introduce passage 208 is connected to the second fuel supply passage 204 in such a way that the passage length of the fuel introduce passage 208 becomes the shortest among the other passage lengths.

In the second embodiment, a passage length of a part of the second fuel supply passage 204 between the nozzle portion 20 and the middle point (a third connecting potion) at which the fuel introduce passage 208 is connected to the second fuel supply passage 204 is defined as "L3", while the passage length of the fuel introduce passage 208 is defined as "L2". Then, in the present embodiment, a relationship of "L3>2×L2" is satisfied.

Figure 6:
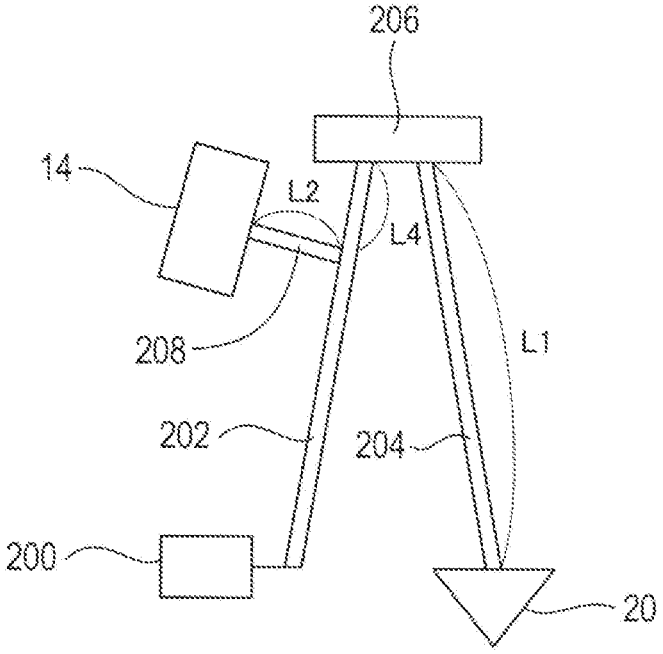
FIG. 6 is a schematic view showing an installation position of a pressure sensor according to a third embodiment of the present disclosure.

According to the third embodiment shown in FIG. 6, it is different from the first embodiment in that the fuel introduce passage 208 is connected to a middle point of the first fuel supply passage 202. The fuel supply passage 208 is connected to the first fuel supply passage 202 in such a way that a passage length of the fuel introduce passage 208 becomes the shortest among the other passage lengths.

In the third embodiment, the passage length of the second fuel supply passage 204 is defined as "L1", the passage length of the fuel introduce passage 208 is defined as "L2", and a passage length of a part of the first fuel supply passage 202 between the passage connecting portion 206 and the middle point (a fourth connecting potion) at which the fuel introduce passage 208 is connected to the first fuel supply passage 202 is defined as "L4". In the present embodiment, a relationship of "(L1+L4)>L2" is satisfied. More preferably, a relationship of "(L1+L4)>(2×L2)" is satisfied.

In addition, in the second and the third embodiments, the passage area of the second fuel supply passage 204 is defined as "S1", while the passage area of the fuel introduce passage 208 is defined as "S4". Then, the relationship of "S1≥S4" is satisfied.

In addition, in the second and the third embodiments, the passage area of the second fuel supply passage 204 is defined as "S1", while the passage area of the first fuel supply passage 202 is defined as "S2" and the passage area of the passage connecting portion 206 is defined as "S3". Then, the relationship of "S1≤S2≤S3" is satisfied.

In each of the second and the third embodiments, the fuel supply main passage 202-204 for supplying the fuel from the fuel inlet port 200 to the nozzle port 20, which includes the first fuel supply passage 202 and the second fuel supply passage 204, extends at first from the fuel inlet port 200 in the first direction to the pressure sensor 14 and then extends from the pressure sensor 14 in the second direction to the nozzle portion 20.

Each of the second and the third embodiments has the following advantage:

(A3) The fuel supply main passage 202-204 does not directly extend from the fuel inlet port 200 to the nozzle portion 20, but includes the first fuel supply passage 202 extending from the fuel inlet port 200 in the first direction to the passage connecting portion 206 opposite to the nozzle portion 20 and the second fuel supply passage 204 extending from the passage connecting portion 206 to the nozzle portion 20. The first and the second fuel supply passages 202 and 204 are connected to each other via the passage connecting portion 206.

The fuel introduce passage 208 is connected to either the first fuel supply passage 202 or the second fuel supply passage 204 depending on the position of the pressure sensor 14.

As above, since the fuel introduce passage 208 is formed depending on the position of the pressure sensor 14, it is possible to precisely detect the fuel pressure by the pressure sensor 14, independently of the position of the pressure sensor 14 and the position of the fuel inlet port 200.

In addition, the fuel introduce passage 208 is connected to the fuel supply main passage 202-204 at the appropriate position, in such a way that the passage length of the fuel introduce passage 208 becomes minimum depending on the position of the pressure sensor 14. It is thereby possible to easily make the passage length of the fuel introduce passage 208 in such a way that the interference is not generated between the injection wave and the reflecting wave.

Fourth to Sixth Embodiments

A basic structure of each of a fourth embodiment to a sixth embodiment is the same to that of the first embodiment. Different points between them will be explained.

In the first embodiment, the fuel introduce passage 208 is formed in the shim 16, which is interposed between the pressure sensor 14 and the valve body 10. The passage connecting portion 206 is formed on the side of the shim 16 opposite to the pressure sensor 14.

Figure 7:
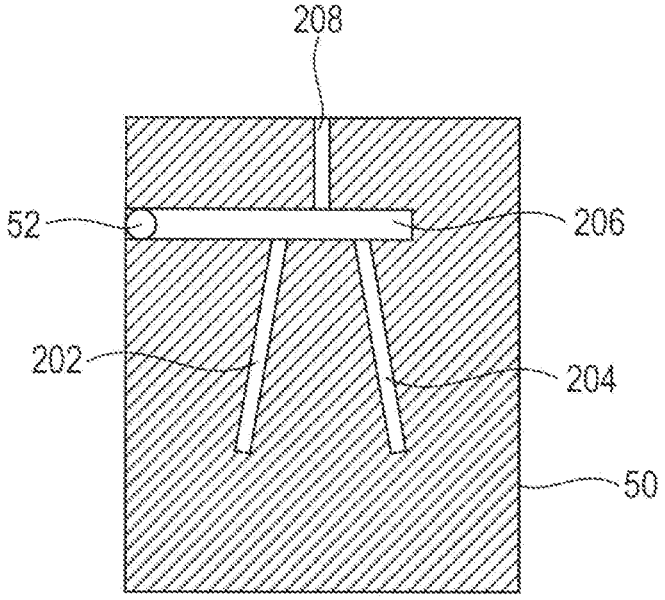
FIG. 7 is a schematic cross-sectional view showing a connecting passage according to a fourth embodiment of the present disclosure.

In the fourth embodiment shown in FIG. 7, the passage connecting portion 206 for connecting the first fuel supply passage 202 to the second fuel supply passage 204 is formed in such a way that a horizontal hole is formed in a valve body 50 to extend from a side wall of the valve body 50 and an open end of the horizontal hole is closed by a plug member 52. The fuel introduce passage 208 is formed in such a way that a vertical hole is formed in the valve body 50 to extend from an upper-side wall in the direction to the passage connecting portion 206.

Figure 8:
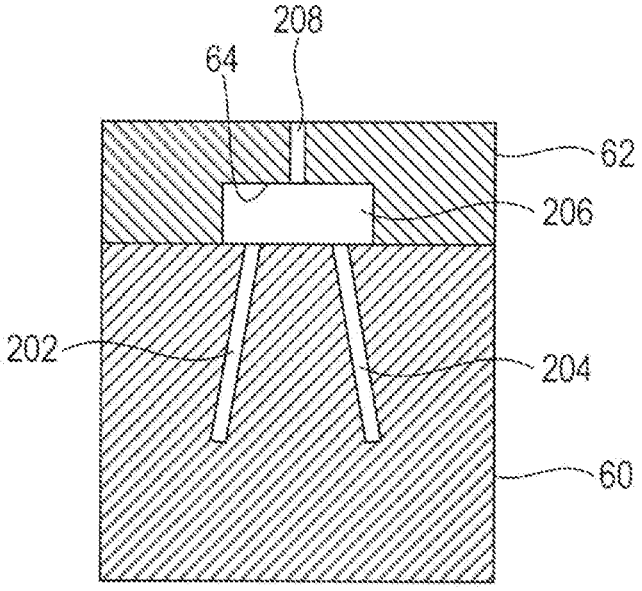
FIG. 8 is a schematic cross-sectional view showing a connecting passage according to a fifth embodiment of the present disclosure.

In a fifth embodiment shown in FIG. 8, a cup-shaped member 62 is connected to an upper-side end of a valve body 60. A recessed portion 64 is formed in the cup-shaped member 62. The recessed portion 64 works as the passage connecting portion 206 for connecting the first and the second fuel supply passages 202 and 204 to each other. The fuel introduce passage 208 is formed in the cup-shaped member 62 in such a way that a through-hole for the fuel introduce passage 208 extends from a bottom of the recessed portion 64 to an upper-side outer surface of the cup-shaped member 62.

Figure 9:
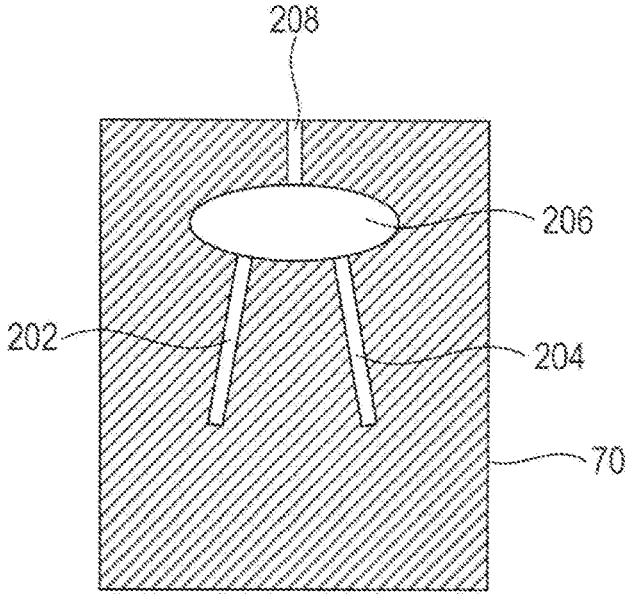
FIG. 9 is a schematic cross-sectional view showing a connecting passage according to a sixth embodiment of the present disclosure.

In a sixth embodiment shown in FIG. 9, the passage connecting portion 206 is formed in a valve body 70 in the following processes. A vertical hole for the fuel introduce passage 208 is formed in the valve body 70 in such a way that the vertical hole extends in an axial-downward direction from an upper-side outer surface of the valve body 70. An electrode is inserted into the vertical hole and the passage connecting portion 206 for connecting the first and the second fuel supply passages 202 and 204 to each other is formed by an electro-spark machining process.

In each of the fourth to the sixth embodiments, the passage area of the second fuel supply passage 204 is defined as "S1", the passage area of the first fuel supply passage 202 is defined as "S2", the passage area of the passage connecting portion 206 is defined as "S3" and the passage area of the fuel introduce passage 208 is defined as "S4". Then, a relationship of "S4≤S1≤S2≤S3" is satisfied. In addition, when the passage length of the second fuel supply passage 204 is defined as "L1" and the passage length of the fuel introduce passage 208 is defined as "L2", a relationship of "L1>L2" is satisfied.

In each of the fourth to the sixth embodiments, the fuel supply main passage 202-204 for supplying the fuel from the fuel inlet port 200 to the nozzle port 20, which includes the first fuel supply passage 202 and the second fuel supply passage 204, extends from the fuel inlet port 200 in the first direction to the pressure sensor 14 and then extends from the pressure sensor 14 in the second direction to the nozzle portion 20.

Each of the fourth to the sixth embodiments has the advantage equal to the above explained advantage (A1) of the first embodiment.

Seventh Embodiment

A basic structure of a seventh embodiment is the same to that of the first embodiment. Different points between them will be explained.

In the first embodiment, the fuel inlet port 200 is provided at the position separated from the longitudinal center of the fuel injection valve 2 in the direction to the nozzle portion 20. The first fuel supply passage 202 extending from the fuel inlet port 200 to the pressure sensor 14 is formed to extend in the first direction away from the nozzle portion 20.

Figure 10:
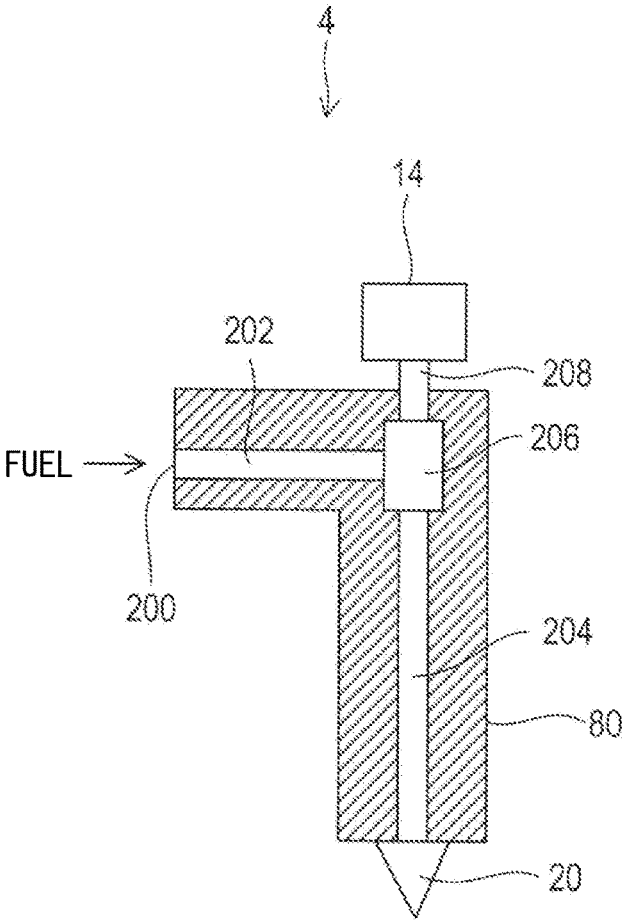
FIG. 10 is a schematic cross-sectional view showing a fuel supply main passage according to a seventh embodiment of the present disclosure.

In a fuel injection valve 4 of a seventh embodiment shown in FIG. 10, the fuel inlet port 200 is formed in a valve body 80 at a position separated from a longitudinal center of the fuel injection valve 4, that is, at an axial end of the fuel injection valve 4 opposite to the nozzle portion 20, in such a way that a horizontal hole for the fuel inlet port 200 and the first fuel supply passage 202 extends from a side wall of the valve body 80. In addition, the first fuel supply passage 202 extends in the first direction to the pressure sensor 14, which is perpendicular to an axis of the fuel injection valve 4.

The pressure sensor 14 is provided at the axial end of the fuel injection valve 4 opposite to the nozzle portion 20, in the same manner to the first embodiment.

In the seventh embodiment, the passage area of the second fuel supply passage 204 is defined as "S1", the passage area of the first fuel supply passage 202 is defined as "S2", the passage area of the passage connecting portion 206 is defined as "S3" and the passage area of the fuel introduce passage 208 is defined as "S4". Then, a relationship of "$S4 \leq S1 \leq S2 \leq S3$" is satisfied. In addition, when the passage length of the second fuel supply passage 204 is defined as "L1" and the passage length of the fuel introduce passage 208 is defined as "L2", a relationship of "$L1 \geq L2$" is satisfied. More preferably, a relationship of "$L1 \geq 2 \times L2$" is satisfied.

In the seventh embodiment, the fuel supply main passage 202-204 for supplying the fuel from the fuel inlet port 200 to the nozzle port 20, which includes the first fuel supply passage 202 and the second fuel supply passage 204, extends from the fuel inlet port 200 in the first direction to the pressure sensor 14 and then extends from the pressure sensor 14 in the second direction to the nozzle portion 20.

The above explained seventh embodiment has the following advantage:

(A4) Even in a case that the fuel inlet port 200 is provided at the position separated from the longitudinal center of the fuel injection valve 2 on the side closer to the pressure sensor 14, the fuel supply main passage 202-204 is composed of the first fuel supply passage 202 extending from the fuel inlet port 200 to the pressure sensor 14 and the second fuel supply passage 204 extending from the pressure sensor 14 to the nozzle portion 20. The first fuel supply passage 202 and the second fuel supply passage 204 are connected to each other via the passage connecting portion 206. The fuel is supplied from the passage connecting portion 206 to the pressure sensor 14 via the fuel introduce passage 208.

As above, it is possible to design the path of the fuel supply main passage 202-204 in such a way that the fuel supply main passage 202-204 extends in the first direction to the pressure sensor 14 and then the fuel supply main passage 202-204 extends in the second direction to the nozzle portion 20 after it approaches the position adjacent to the pressure sensor 14. Therefore, it is possible to design the path of the fuel supply main passage 202-204 in such a way that the passage length (L2) of the fuel introduce passage 208 for introducing the fuel from the fuel supply main passage 202-204 to the pressure sensor 14 becomes shorter.

As a result, it is possible to decide the length of the fuel introduce passage 208 in such a way that the injection wave and the reflecting wave do not interfere with each other. Namely, the injection wave is transmitted from the fuel supply main passage (the second fuel supply passage 204) to the fuel introduce passage 208, while the injection wave is reflected at the boundary between the fuel supply main passage and the fuel introduce passage 208 and thereby the reflecting wave reciprocating in the fuel introduce passage 208 is generated. In the present embodiment, the frequency range of the reflecting wave is separated from the frequency range of the injection wave, to avoid thereby the interference between them.

It is, therefore, possible to precisely detect the fuel pressure by the pressure sensor 14, independently from the positions of the fuel inlet port 200 and the pressure sensor 14.

Further Embodiments and/or Modifications

The present disclosure is explained with reference to the drawings. However, the present disclosure is not limited to the above embodiments but can be further modified in various manners without departing from a spirit of the present disclosure.

(M1) In the above embodiments, the fuel supply main passage 202-204 for supplying the fuel from the fuel inlet port 200 to the nozzle portion 20 is composed of the first fuel supply passage 202 and the second fuel supply passage 204, wherein the first and the second fuel supply passages 202 and 204 are connected to each other via the passage connecting portion 206.

The above embodiments may be modified in the following manner. The passage connecting portion 206 may not be always formed depending on the positions of the fuel inlet port 200 and the pressure sensor 14. Instead of providing the passage connecting portion 206, one fuel supply main passage may supply the fuel from the fuel inlet port to the nozzle portion. In such a modified structure, the fuel supply main passage is designed to extend from the fuel inlet port to the pressure sensor and further extend from the pressure sensor to the nozzle portion.

(M2) In the above embodiments, the passage area of the second fuel supply passage 204 is defined as "S1", the passage area of the first fuel supply passage 202 is defined as "S2", the passage area of the passage connecting portion 206 is defined as "S3" and the passage area of the fuel introduce passage 208 is defined as "S4". The relationship of "$S4 \leq S1 \leq S2 \leq S3$" is satisfied. However, the passage areas may satisfy at least the relationship of "$S1 < S4$". Alternatively, a relationship of "$S1 \leq S2 \leq S3 < S4$" may be satisfied.

(M3) Multiple functions of one component of the above embodiments may be realized by multiple components. Alternatively, one function of one component may be realized by multiple components. Furthermore, multiple functions of multiple components may be realized by one component. One function achieved by multiple components may be realized by one component. One of the components in the above embodiments may be eliminated. A part of the structure of the above embodiment may be added to or replaced by the structure of the other embodiment.

What is claimed is:

1. A fuel injection valve comprising:

a nozzle portion for injecting fuel therefrom;

a fuel inlet port formed in a valve body;

a fuel supply main passage formed in the valve body for supplying the fuel from the fuel inlet port to the nozzle portion;

a pressure sensor provided in the valve body for detecting fuel pressure in the fuel supply main passage; and a fuel introduce passage for supplying the fuel from the fuel supply main passage to the pressure sensor, wherein the fuel supply main passage extends in a first direction from the fuel inlet port to the pressure sensor and then further extends in a second direction from the pressure sensor to the nozzle portion, wherein:

the fuel supply main passage includes a first fuel supply passage connected to the fuel inlet port and a second fuel supply passage connected to the nozzle portion, a passage connecting portion is formed for connecting the first fuel supply passage and the second fuel supply passage to each other, the first fuel supply passage extends from the fuel inlet port in the first direction opposite to the second direction to the nozzle portion, the second fuel supply passage extends from the passage connecting portion to the nozzle portion, the fuel introduce passage is connected to the passage connecting portion, and the fuel introduce passage is a separately branched passage which is branched off from the passage connecting portion and is formed separately from the first fuel supply passage and the second fuel supply passage.

2. The fuel injection valve according to claim 1, wherein:

an interposed member is provided between the pressure sensor and the valve body, in which the passage connecting portion is formed, and the fuel introduce passage is formed in the interposed member.

3. The fuel injection valve according to claim 1, wherein:

the valve body has a shape defining a longitudinal center, and the fuel inlet port is formed at a position separated from the longitudinal center of the valve body.

4. The fuel injection valve according to claim 3, wherein:

the fuel inlet port is formed on a peripheral surface of the valve body.

5. The fuel injection valve according to claim 4, wherein:

the nozzle portion is provided on one end of the valve body, the pressure sensor is provided on the other end of the valve body, the fuel inlet port is located between the nozzle portion and the pressure sensor, the passage connecting portion is located between the fuel inlet port and the pressure sensor, the first fuel supply passage extends between the fuel inlet port and the passage connecting portion, and the second fuel supply passage extends between the passage connecting portion and the nozzle portion.

6. The fuel injection valve according to claim 5, wherein:

the fuel inlet port is formed on a side closer to the nozzle portion.

* * * * *